US007135141B2

(12) United States Patent
Han et al.

(10) Patent No.: US 7,135,141 B2
(45) Date of Patent: Nov. 14, 2006

(54) METHOD OF MANUFACTURING A SINTERED BODY

(75) Inventors: Gang Han, Yonago (JP); Tomonori Ueno, Yasuki (JP); Eiji Hirakawa, Yonago (JP); Shujiro Uesaka, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 10/810,673

(22) Filed: Mar. 29, 2004

(65) Prior Publication Data

US 2004/0191108 A1 Sep. 30, 2004

(30) Foreign Application Priority Data

Mar. 31, 2003 (JP) ..... 2003-093645
Sep. 3, 2003 (JP) ..... 2003-311148

(51) Int. Cl.
*B22F 3/12* (2006.01)

(52) U.S. Cl. ..... 419/54; 419/49

(58) Field of Classification Search ..... 419/38, 419/49, 54

See application file for complete search history.

(56) References Cited

U.S. PATENT DOCUMENTS 5,011,742 A * 4/1991 Fife et al. ..... 428/558
5,051,218 A * 9/1991 Matthews ..... 264/40.6
5,147,086 A * 9/1992 Fujikawa et al. ..... 228/235.1
6,171,363 B1 * 1/2001 Shekhter et al. ..... 75/369
6,261,337 B1 * 7/2001 Kumar ..... 75/255
6,461,989 B1 * 10/2002 El-Raghy et al. ..... 501/87
6,521,173 B1 * 2/2003 Kumar et al. ..... 419/23
6,582,651 B1 * 6/2003 Cochran et al. ..... 419/5
6,607,693 B1 * 8/2003 Saito et al. ..... 420/417
6,783,696 B1 * 8/2004 Conte et al. ..... 252/181.1
2002/0028175 A1 * 3/2002 Fife ..... 423/592
2002/0041819 A1 * 4/2002 Kumar et al. ..... 419/66
2003/0133824 A1 * 7/2003 Taguchi et al. ..... 420/70
2003/0211001 A1 * 11/2003 Ivasishin et al. ..... 419/39
2004/0118247 A1 * 6/2004 Woodfield et al. ..... 75/351
2005/0084445 A1 * 4/2005 Kimmel et al. ..... 423/594.17

FOREIGN PATENT DOCUMENTS

JP 2000-144396 5/2000

* cited by examiner

*Primary Examiner*—Daniel Jenkins
(74) *Attorney, Agent, or Firm*—Sughrue Mion, PLLC

(57) ABSTRACT

A method of manufacturing a sintered body, in which a material powder composed of metallic powder or alloy powder, a getter material having a higher oxidation potential than that of the material powder, and a hydride, which constitutes a hydrogen source, are sealed under reduced pressure in a metallic container, and subjected to pressurized sintering while being heated. The pressurized sintering is performed by keeping the metallic container at pressure not higher than 50 MPa and at temperature not lower than 500° C. for 1 to 50 hours, and then sintering the metallic powder and the alloy powder at pressure higher than 50 MPa and at temperature not higher than 1340° C.

9 Claims, 7 Drawing Sheets

METHOD OF MANUFACTURING A SINTERED BODY

FIELD OF THE INVENTION

The present invention relates to a method of manufacturing a sintered body, in which oxygen is reduced.

BACKGROUND OF THE INVENTION

Powder sintering methods are classified into one with no pressurization and one with pressurization such as hot pressing and hot isostatic pressing. While the sintering method with no pressurization enables reduction of oxygen in a sintered body by virtue of performing sintering in a reducing atmosphere such as hydrogen or the like, it is thought in the powder sintering method with pressurization such as hot isostatic pressing or the like that it is difficult to remarkably reduce oxygen after sealing because powder is confined in a capsule such as metallic container or the like to be subjected to sintering, and so the method depends much upon reduction of oxygen quantity in a material powder.

Recently, proposed as a method of oxygen reduction in a sintered body is, for example, a method of moving and reducing oxygen from a material being sintered, by having a getter metal, from which an oxide is formed at a sintering temperature to be lower in oxygen dissociation pressure than an oxide formed from a metallic material being sintered, existing in an inner portion of a metallic capsule in contact with the material being sintered, when hot isostatic pressing is carried out (for example, JP-A-2000-144396).

JP-A-2000-144396 discloses removal of oxygen from a material being sintered, by having a getter material existing in an inner portion of a metallic container in contact with the material being sintered, to permit oxygen existing in the material being sintered to diffuse on a surface of the material being sintered, to combine with the getter material.

In the case where a getter material together with a material being sintered is sealed in a metallic container in a manner to be made existent in a portion of the metallic container in contact with the material being sintered, and pressurized sintering is performed, however, effectiveness of oxygen removal caused by the getter material is liable to appear in only that surface layer portion of a sintered body, which comes into contact with the getter material, and oxygen in the sintered body cannot be adequately reduced, so that there remains a problem that it is not possible to generally evenly reduce oxygen remained in the sintered body.

SUMMARY OF THE INVENTION

It is an object of the invention to solve the above problem and to provide a method of manufacturing a sintered body, which method is capable of generally evenly reducing oxygen in the sintered body and remarkably improving the capacity of deoxygenation.

As a result of having made various examinations into oxygen reduction methods based on the pressurized sintering method, the inventors of the present application have found that oxygen constituting impurities inevitably contained in a sintered body can be further reduced by sealing metallic powder or alloy powder and a getter material having a higher oxidation potential than that of the metallic powder or alloy powder under reduced pressure in a metallic container, expediting the deoxygenation reaction at low pressure and in a temperature range, in which deoxygenation reaction occurs, and adopting a heating and pressurizing pattern, in which main sintering is performed under a high-temperature and high-pressure condition, after the deoxygenation reaction has proceeded, and have thus reached the present invention.

More specifically, the invention provides a method of manufacturing a sintered body, comprising sealing a material powder composed of metallic powder or alloy powder and a getter material having a higher oxidation potential than that of the material powder under reduced pressure in a metallic container, keeping the metallic container at pressure not higher than 50 MPa and at temperature not lower than 500° C. for 1 to 50 hours, and then sintering the material powder at pressure higher than 50 MPa and at temperature not higher than 1340° C.

Further, the invention provides a method of manufacturing a sintered body, comprising sealing a material powder composed of metallic powder or alloy powder, a getter material having a higher oxidation potential than that of the material powder, and a hydride, which constitutes a hydrogen source, under reduced pressure in a metallic container, keeping the metallic container at pressure not higher than 50 MPa and at temperature not lower than 500° C. for 1 to 50 hours, and then sintering the material powder at pressure higher than 50 MPa and at temperature not higher than 1340° C.

Also, it is preferable in the invention that the getter material comprises an element belonging to the IVa group or the Va group of the periodic table of the elements, and an element combining with hydrogen to form the hydride has a hydrogen dissociation temperature higher than 400° C. Also, it is desirable in the invention that a material powder having the melting point of not lower than 1600° C. be applied to the manufacture of a sintered body and it is preferable in the invention that a sintered body manufactured according to the invention be used as a sputtering target material since it contains a low content of oxygen.

According to the invention, oxygen in a sintered body produced by pressurized sintering can be made generally uniform and the capacity of deoxygenation can be remarkably enhanced, so that a technique essential for manufacture of a sintered body is provided.

DESCRIPTION OF THE PREFERRED EMBODIMENTS

Figure 1:
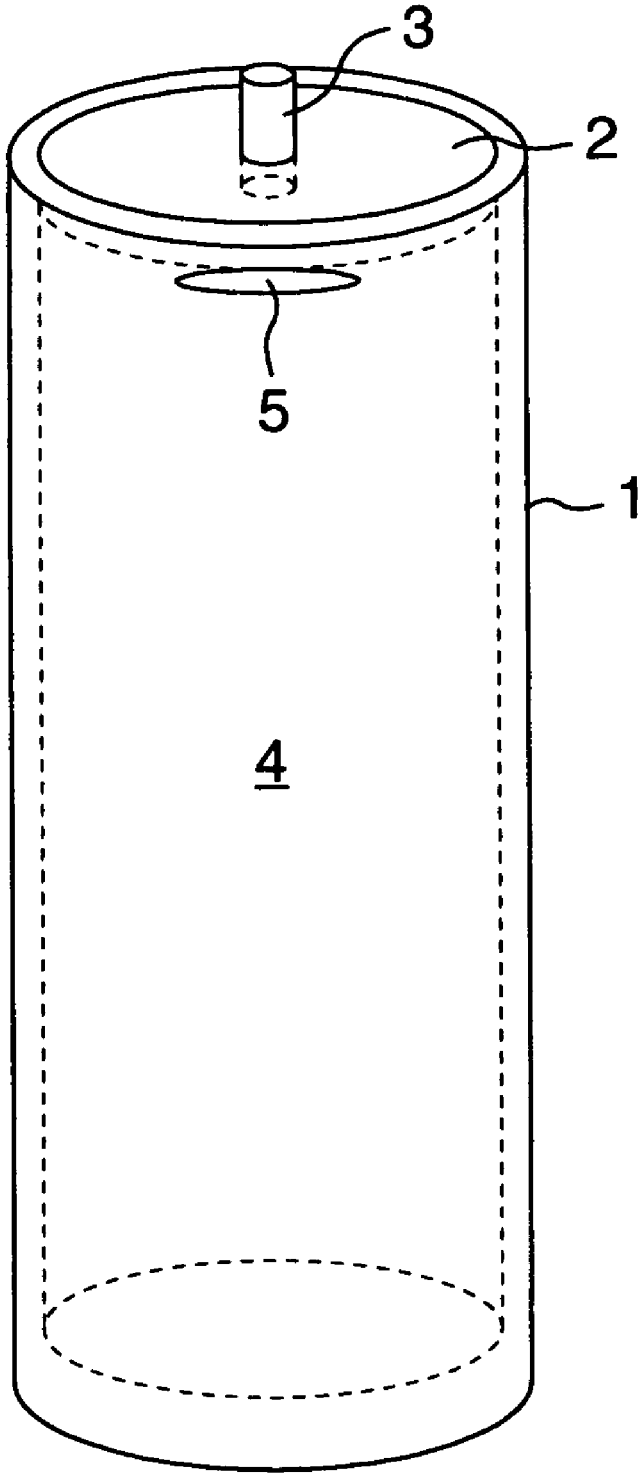
FIG. 1 is a view showing a state of a metallic container, in which a material powder is filled, in Examples 1 to 4.

As described above, an important feature of the invention resides in that in manufacturing a sintered body, a material powder and a getter material having a higher oxidation potential than that of the material powder are sealed in a metallic container, and oxygen contained in the material powder is reduced to the getter material in those ranges of temperature and pressure, in which sintering of the material powder is not started, whereby the processing of deoxygenation is performed on the material powder and subsequently sintering is caused to proceed at high temperature and high pressure to realize a sintered body, in which oxygen being an impurity element is reduced.

In a method of manufacturing a sintered body, according to the invention, a material powder composed of metallic powder or alloy powder and a getter material having a higher oxidation potential than that of the material powder are sealed under reduced pressure in a metallic container. In this case, while further supplying of oxygen is cut off, oxygen is present as oxygen adsorbed by interiors and surfaces of the material powder and an oxide disposed on surfaces of the material powder in the metallic container. The material powder and the getter material are sealed under reduced pressure in the metallic container, and heat treatment is applied thereon at low temperature and low pressure, at which sintering is hard to proceed and the deoxygenation reaction can proceed, in a state, in which further supplying of oxygen is cut off. In the case where heat treatment is carried out under that condition, in which sintering is hard to proceed, the material powder filled in the metallic container is put in a state, in which it is porous to leave voids therein, so that oxygen dissociates from the material powder without internally diffusing into a sintered body as compacted and mass transfers to the getter material as oxygen gases or vapor of low-valent oxide. Therefore, deoxygenation is greatly enhanced in efficiency.

An effect of oxygen removal can be produced by selecting, as a getter material in the invention, a metallic element having a higher affinity for oxygen than that of an element constituting a matrix of a sintered body, that is, a metallic element having a high oxidation potential.

Also, when heat treatment is applied on the material powder under that condition, in which pressure is not higher than 50 MPa and temperature is not lower than 500° C., the deoxygenation reaction can proceed without rapid expedition of sintering. Also, since the effect of deoxygenation is improved with time for heat treatment, the deoxygenation reaction preferably proceeds in 50 hours or shorter when taking account of the necessity of time not shorter than 1 hour for heat treatment, and of the efficiency of sintering.

Also, according to the above condition, a sintered body is fabricated by pressurized sintering a material powder, of which surfaces are clean, after the deoxygenation reaction has proceeded adequately. In fabricating a sintered body by means of pressurized sintering, it is desirable to apply pressure not lower than 50 MPa on the metallic container. The reason for this is that when pressurized sintering is performed at pressure not higher than the above-mentioned pressure, it is hard to fabricate a sintered body having a sufficient density. Also, the temperature condition at the time of pressurized sintering must be set taking account of the heat-resisting temperature of the metallic container. In the case where a metallic container formed from a low carbon steel is used, sintering is desirably performed at temperature not higher than 1340° C. The reason for this is that when pressurized sintering is performed at temperature higher than the above-mentioned temperature, the temperature approaches the melting point of the metallic container itself and the metallic container itself melts to contaminate a resulting sintered body. Also, in order to make a sintered body high in density, it is preferable to use hot pressing and hot isostatic pressing (HIP) for pressurized sintering.

Also, in the manufacturing method according to the invention, it is desired that a material powder composed of metallic powder or alloy powder, a getter material having a higher oxidation potential than that of the material powder, and a hydride, which constitutes a hydrogen source, be sealed under reduced pressure in a metallic container. The reason for this is that when heating is performed in a state, in which the hydride, which constitutes a hydrogen source, as well as the material powder and the getter material are sealed under reduced pressure in the metallic container and further supplying of oxygen is cut off, hydrogen dissociating from the hydride is believed to serve as a carrier of oxygen from the material powder to the getter material when oxygen existing in the metallic container combines with the getter material having a high oxidation potential.

More specifically, oxygen present on the surfaces of the material powder is first subjected to hydrogen reduction to make $H_2O$ molecules. Then the $H_2O$ molecules move to the getter material and the $H_2O$ are reduced by the getter material to make $H_2$. That is, it is thought that hydrogen serves as a carrier to transport oxygen of the material powder to the getter material to expedite deoxygenation further efficiently.

It is desired that the hydride, which constitutes a hydrogen source, be one having the hydrogen dissociation temperature higher than 400° C. The reason for this is that since a metallic container is usually sealed under reduced pressure at around 400° C., hydrogen separates in the course of pressure reduction and is discharged outside the metallic container due to the deoxygenation processing when a hydride having the hydrogen dissociation temperature not higher than 400° C. is made use of. For example, hydrides of Ti and Zr can be used as the hydride.

Also, in order to act as a getter, it is necessary for the getter material in the invention to have a higher oxidation potential than that of the material powder. Therefore, a getter material is selected according to a kind of the material powder. In the case where, for example, Mo, Mo alloy, and Ru are used as the material powder, it is conceivable that those elements belonging to the Ia to Va group of the periodic table of the elements, which have a higher oxidation potential than that of such material powder, be used as the getter material. In view of cost and the quality of handling, elements belonging to the IVa group (Ti, Zr, Hf) or the Va group (V, Nb, Ta) of the periodic table of the elements are desirable among the materials described above.

Further, powder of elements having the melting point not lower than 1600° C. is desirably used as the metallic powder and the alloy powder. Since powder of the elements is in many cases manufactured by refining with the use of a chemical process and hydrogen reduction on an oxide in a final process, oxygen is left in a large amount on powder surfaces. Also, powder manufactured in the chemical process is in many cases porous one, due to which oxygen is frequently left on powder surfaces. Therefore, since there is a great need of reducing oxygen in the case where a sintered body is manufactured from powder of the elements, the method of manufacturing a sintered body, according to the invention, is preferable when a sintered body is manufactured from powder of the elements. Also, when a material of the element is to be manufactured, the sintering process is usually applied due to its high melting point, so that the manufacturing method according to the invention is preferable in such application in order to reduce oxygen in manufacture of the element.

Also, since the method of manufacturing a sintered body, according to the invention, is highly effective in reduction of oxygen in a sintered body, it is preferable as a method of manufacturing a sputtering target material of low oxygen content for formation of thin film used in information industries. Also, since a sintered body subjected to pressurized sintering after the deoxygenation processing has a grain boundary in a cleaned condition, it is very useful in reducing generation of particles during sputtering. Therefore, a sintered body manufactured by the present method is especially optimum for a sputtering target material.

EXAMPLE 1

As shown in FIG. 1, after Mo powder being material powder 4 containing oxygen of 250 mass ppm was filled in a metallic container 1 of low carbon steel with a powder filling space having a diameter of 50 mm and a height of 250 mm, and eight Nb foil pieces having a diameter of 40 mm and a thickness of 0.1 mm, four Ta foil pieces having a diameter of 40 mm and a thickness of 0.12 mm, or Zr powder 17*g* were arranged as a getter material 5 on a back side of an upper lid 2 of the metallic container, the upper lid of the metallic container with a deaerating port 3 was welded to the metallic container, pressure reducing evacuation was performed through the deaerating port 3 up to $1.0\times10^{-2}$ Pa or less, and sealing was effected. Also, in a comparative sample, a metallic container, in which the getter material was not arranged but the material powder was filled, was also fabricated.

Figure 2:
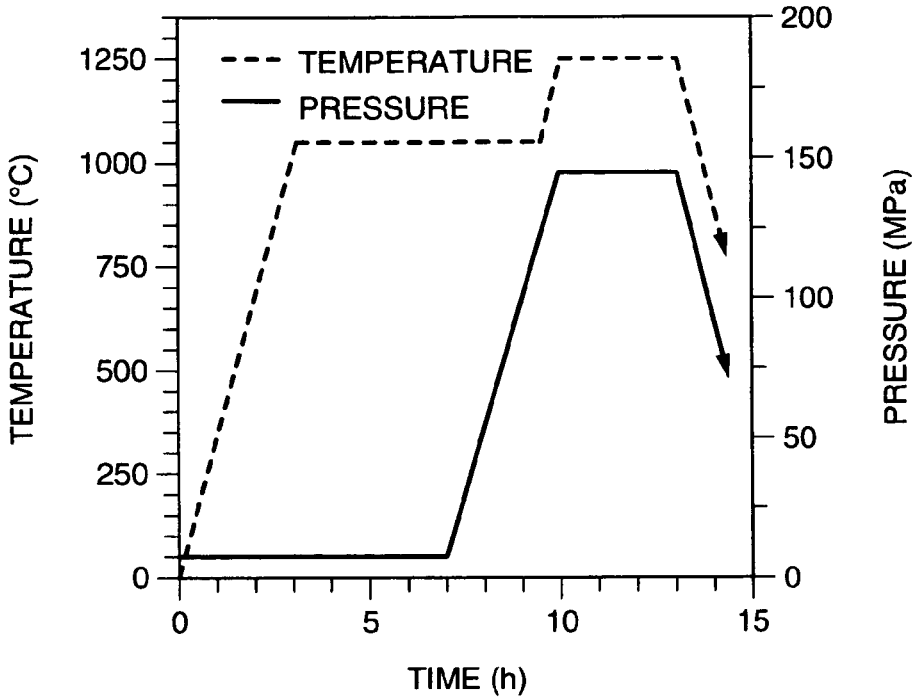
FIG. 2 is a graph showing conditions of temperature and pressure in HIP of the invention in an Example 1.

The metallic container fabricated thus and filled with the Mo powder was subjected to sintering under a HIP condition shown in FIG. 2.

The HIP condition of the invention shown in FIG. 2 included room temperature as an initial temperature, 8 MPa as an initial pressure, and temperature-rise up to 1050° C. in first 3 hours and keeping the temperature for 4 hours. Thereafter, the pressure was increased to 146 MPa over 3 hours, the temperature was raised to 1250° C. for 3 hours since 2.5 hours out of the 3 hours had elapsed, and the temperature was kept for 3 hours as it was. Thereafter, the temperature and the pressure were decreased for termination of the HIP.

Figure 3:
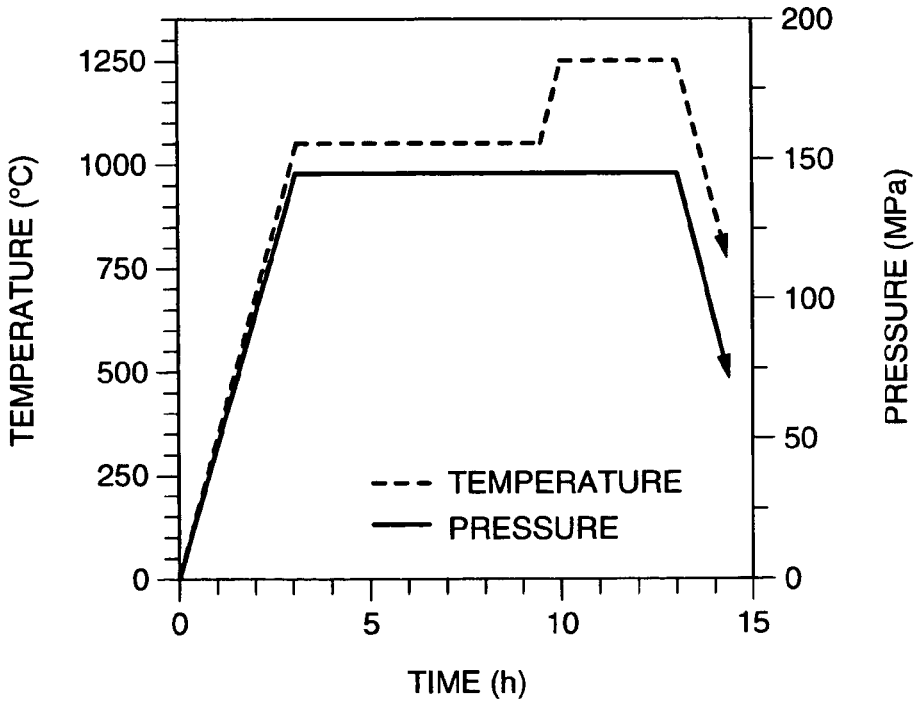
FIG. 3 is a graph showing conditions of temperature and pressure in HIP of a comparative sample in the Example 1.

Further, the metallic container filled with the Mo powder in the same manner was used and subjected to sintering under a HIP condition shown in FIG. 3, in which the initial heating and keeping were not performed, unlike the invention.

The HIP condition shown in FIG. 3 included room temperature as an initial temperature, 8 MPa as an initial pressure, and temperature-rise up to 1050° C. and pressure-rise in first 3 hours and keeping the temperature and the pressure for 6.5 hours. Thereafter, the temperature was raised to 1250° C. over 0.5 hours, and was then kept for 3 hours. Thereafter, the temperature and the pressure were decreased for termination of the HIP.

Figure 4:
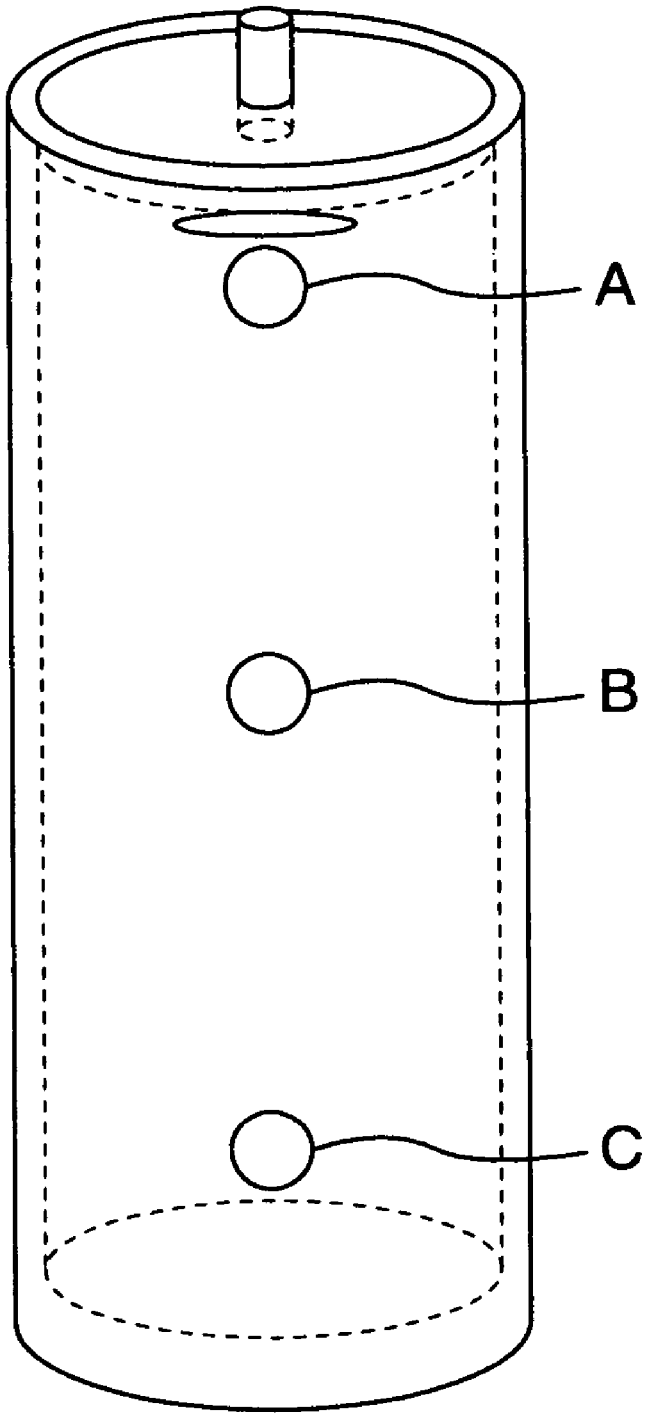
FIG. 4 is a view showing positions, at which test pieces for oxygen analysis are taken from a sintered body, in samples.

After the sintering had been terminated, test pieces for oxygen analysis were taken from the sintered bodies of the sample of the invention and the comparative sample at respective positions shown in FIG. 4, that is, a position A, a position B, and a position C, at 25 mm, 125 mm, and 225 mm, respectively, from the getter material, and the analysis of oxygen quantity was performed by means of the LECO method.

TABLE 1 shows results of the analysis of sintered bodies in a sample 1 of the invention, in which the Nb foil pieces subjected to sintering under the HIP condition shown in FIG. 2 were used as the getter material, a sample 2 of the invention, in which the Ta foil pieces subjected to sintering in the same manner as that described above were used as the getter material, and a sample 3 of the invention, in which the Zr powder subjected to sintering in the same manner as that described above was used as the getter material, and a sintered body of the comparative sample 4 with no getter material in the metallic container.

Also, TABLE 2 shows results of the analysis of sintered bodies in a comparative sample 5, in which the Nb foil pieces subjected to sintering under that HIP condition, which is shown in FIG. 3 and different from that in the invention, were used as the getter material, a comparative sample 6, in which the Ta foil pieces subjected to sintering in the same manner as that described above were used as the getter material, a comparative sample 7, in which the Zr powder subjected to sintering in the same manner as that described above was used as the getter material, and a sintered body in a comparative sample 8 with no getter material in the metallic container. Oxygen quantities in TABLE 1 and TABLE 2 are expressed in mass ppm.

It is seen from TABLE 1 and TABLE 2 that sintered bodies in the samples 1, 2 and 3 of the invention, in which the getter material was arranged in the metallic container and the processing of expediting deoxidation prior to the main sintering at the time of HIP was incorporated, were adequately reduced in oxygen quantity irrespective of positions in the sintered bodies.

TABLE 1

| Sample No. | Getter Material | Oxygen Quantity (ppm) Position A | Position B | Position C | Note |
|---|---|---|---|---|---|
| 1 | Nb Foil Piece | 90 | 90 | 100 | Examples of invention |
| 2 | Ta Foil Piece | 70 | 90 | 100 | |
| 3 | Zr Powder | 50 | 70 | 90 | |
| 4 | None | 260 | 270 | 270 | Comparative Example |

TABLE 2

| Sample No. | Getter Material | Oxygen Quantity (ppm) Position A | Position B | Position C | Note |
|---|---|---|---|---|---|
| 5 | Nb Foil Piece | 100 | 220 | 250 | Comparative Examples |
| 6 | Ta Foil Piece | 80 | 220 | 230 | |
| 7 | Zr Powder | 70 | 210 | 220 | |
| 8 | None | 270 | 280 | 270 | |

EXAMPLE 2

Like the Example 1, as shown in FIG. 1, after Ru material powder being material powder 4 containing oxygen of 1000 mass ppm was filled in a metallic container 1 of low carbon steel with a powder filling space having a diameter of 50 mm and a height of 250 mm, and four Ta foil pieces having a diameter of 40 mm and a thickness of 0.12 mm were arranged as a getter material 5 on a back side of an upper lid 2 of the metallic container, the upper lid of the metallic container with a deaerating port 3 was welded to the metallic container, pressure reducing evacuation was performed through the deaerating port 3 up to $1.0\times10^{-2}$ Pa or less, and sealing was effected.

Figure 5:
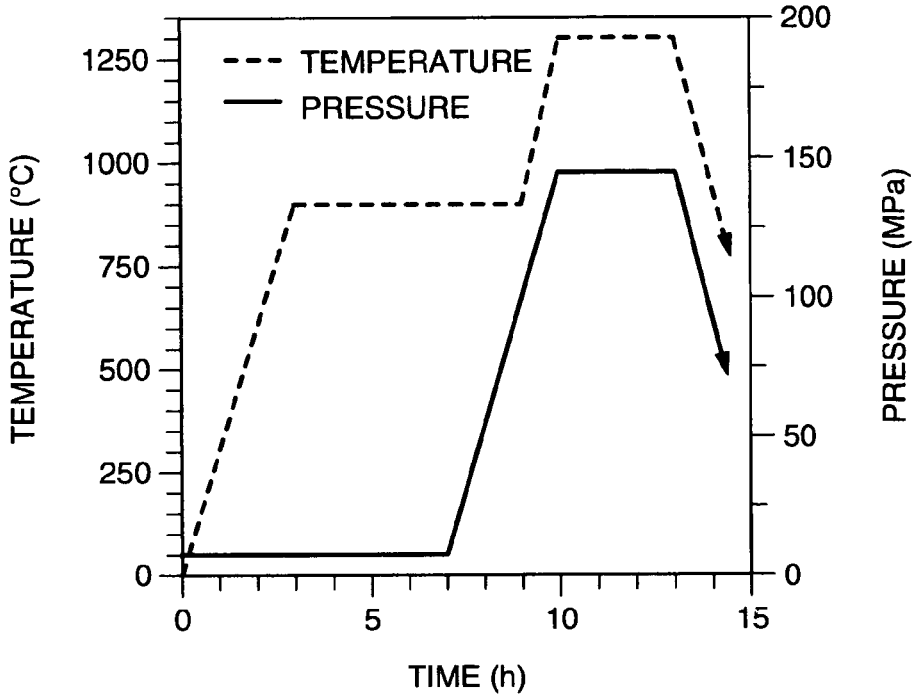
FIG. 5 is a graph showing conditions of temperature and pressure in HIP of the invention in an Example 2.

The metallic container fabricated in the above manner and filled with the Ru material powder was subjected to sintering under a HIP condition shown in FIG. 5, and a resulting sintered body was made a sample 9 of the invention. Also, in a comparative sample, sintering was performed under a different HIP condition from that in the invention and shown in FIG. 6, and a resulting sintered body was made a comparative sample 10.

The HIP condition of the invention shown in FIG. 5 included room temperature as an initial temperature, 8 MPa as an initial pressure, and temperature-rise up to 900° C. in first 3 hours and keeping the temperature for 4 hours. Thereafter, the pressure was increased to 146 MPa over 3 hours, the temperature was raised to 1300° C. over 3 hours since 2 hours out of the above 3 hours had elapsed, and the temperature was kept for 3 hours. Thereafter, the temperature and the pressure were decreased for termination of the HIP.

Figure 6:
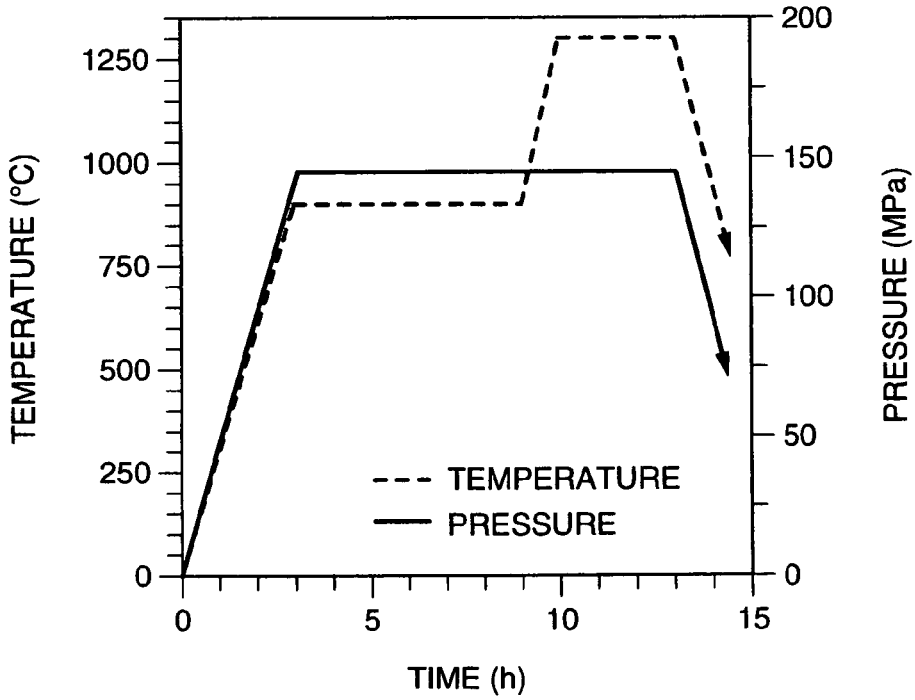
FIG. 6 is a graph showing conditions of temperature and pressure in HIP of a comparative sample in the Example 2.

The HIP condition of the comparative sample shown in FIG. 6 included room temperature as an initial temperature, 8 MPa as an initial pressure, and temperature-rise up to 900° C. and pressure-rise to 146 MPa in first 3 hours, and keeping the temperature and the pressure for 6 hours. Thereafter, the temperature was raised to 1300° C. over 1 hour, and the temperature was kept for 3 hours. Thereafter, the temperature and the pressure were decreased for termination of the HIP.

After the sintering had been terminated, test pieces for oxygen analysis were taken from the sintered bodies of the sample 9 of the invention and the comparative sample 10 at the position A, the position B, and the position C shown in FIG. 4 in the same manner as in the Example 1, and the analysis of oxygen quantity was performed by means of the LECO method. TABLE 3 shows results of the oxygen analysis. Oxygen quantities in TABLE 3 are expressed in mass ppm. It is seen from TABLE 3 that the sintered body in the sample 9 of the invention, in which the getter material was arranged in the metallic container and the processing of expediting deoxidation prior to the main sintering at the time of HIP was incorporated, was adequately reduced in oxygen quantity irrespective of positions in the sintered body.

TABLE 3

| Sample No. | HIP Condition | Oxygen Quantity (ppm) Position A | Position B | Position C | Note |
|---|---|---|---|---|---|
| 9 | FIG. 5 | 150 | 160 | 160 | Example of Invention |
| 10 | FIG. 6 | 140 | 300 | 350 | Comparative Example |

EXAMPLE 3

Like the Example 1, as shown in FIG. 1, after Mo material powder being material powder 4 containing oxygen of 250 mass ppm was filled in a metallic container 1 of low carbon steel with a powder filling space having a diameter of 50 mm and a height of 250 mm, and four Ta foil pieces having a diameter of 40 mm and a thickness of 0.12 mm were arranged as a getter material 5 on a back side of an upper lid 2 of the metallic container, the upper lid of the metallic container with a deaerating port 3 was welded to the metallic container, pressure reducing evacuation was performed through the deaerating port 3 up to $1.0\times10^{-2}$ Pa or less, and sealing was effected.

Figure 7:
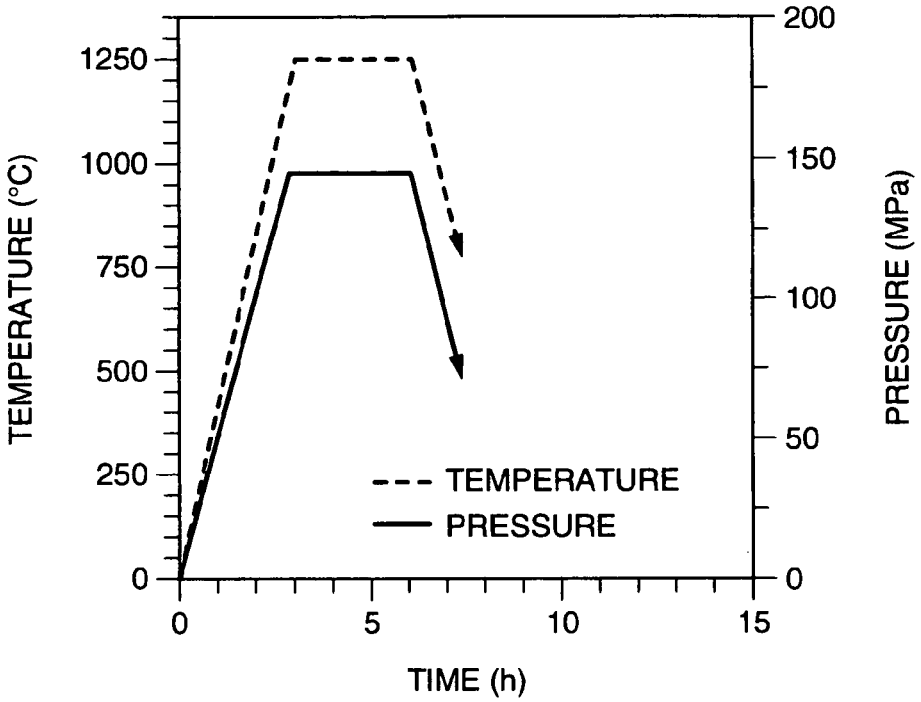
FIG. 7 is a graph showing conditions of temperature and pressure in HIP of the invention in an Example 3.

The metallic container fabricated in the above manner and filled with the Mo material powder was subjected to heat treatment of 850° C.×20 hours in an Ar atmosphere at the atmospheric pressure, and then subjected to sintering under a HIP condition shown in FIG. 7, and a resulting sintered body was made a sample 11 of the invention. Also, in a comparative sample, heat treatment was not performed prior to HIP sintering but sintering under a HIP condition in FIG. 7 was performed, and a resulting sintered body was made a comparative sample 12.

The HIP condition shown in FIG. 7 included room temperature as an initial temperature, 8 MPa as an initial pressure, and temperature-rise up to 1250° C. and pressure-rise to 146 MPa in first 3 hours, and keeping the temperature and the pressure for 3 hours. Thereafter, the temperature and the pressure were decreased for termination of the HIP.

After the sintering had been terminated, test pieces for oxygen analysis were taken from the sintered bodies of the sample 11 of the invention and the comparative sample 12 at the position A, the position B, and the position C shown in FIG. 4 in the same manner as in the Example 1, and the analysis of oxygen quantity was performed by means of the LECO method. TABLE 4 shows results of the oxygen analysis. Oxygen quantities in TABLE 4 are expressed in mass ppm. It is seen from TABLE 4 that the sintered body, in which the getter material was arranged in the metallic container and the processing of expediting deoxidation prior to the main sintering at the time of HIP was incorporated, was adequately reduced in oxygen quantity irrespective of positions in the sintered body.

TABLE 4

| Sample No. | Heat Treatment | Oxygen Quantity (ppm) Position A | Position B | Position C | Note |
|---|---|---|---|---|---|
| 11 | Applied | 80 | 80 | 100 | Example of Invention |
| 12 | None | 90 | 200 | 230 | Comparative Example |

EXAMPLE 4

Like the Example 1, as shown in FIG. 1, after Ru material powder being material powder 4 containing oxygen of 1000 mass ppm was filled in a metallic container 1 of low carbon steel with a powder filling space having a diameter of 50 mm and a height of 250 mm, and four Ta foil pieces having a diameter of 40 mm and a thickness of 0.12 mm were arranged as a getter material 5 on a back side of an upper lid 2 of the metallic container, the upper lid of the metallic container with a deaerating port 3 was welded to the metallic container, pressure reducing evacuation was performed through the deaerating port 3 up to $1.0\times10^{-2}$ Pa or less, and sealing was effected.

Figure 8:
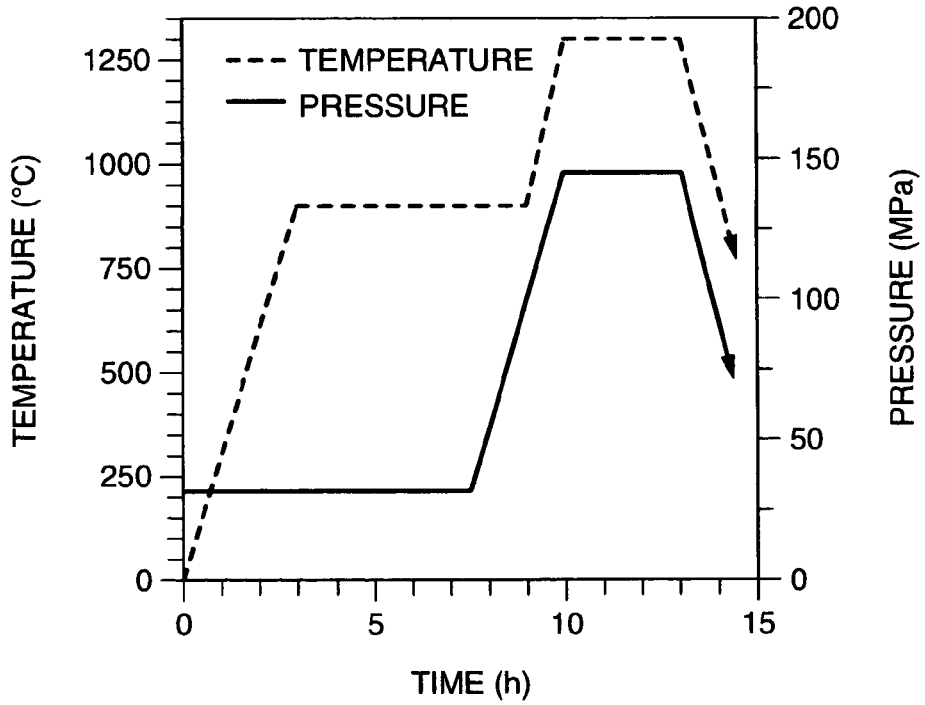
FIG. 8 is a graph showing conditions of temperature and pressure in HIP of the invention in an Example 4.

The metallic container fabricated in the above manner and filled with the Ru material powder was subjected to sintering under a HIP condition shown in FIG. 8, and a resulting sintered body was made a sample 13 of the invention. Also, in a comparative sample, sintering was performed under a HIP condition different from that in the invention and shown in FIG. 9, and a resulting sintered body was made a comparative sample 14.

The HIP condition of the invention shown in FIG. 8 included room temperature as an initial temperature, 31 MPa as an initial pressure, and temperature-rise up to 900° C. in first 3 hours and keeping the temperature for 4.5 hours. Thereafter, the pressure was increased to 146 MPa over 2.5 hours, the temperature was raised to 1300° C. over 3 hours since 1.5 hours out of the above 2.5 hours had elapsed, and the temperature was kept for 3 hours as it was. Thereafter, the temperature and the pressure were decreased for termination of the HIP.

Figure 9:
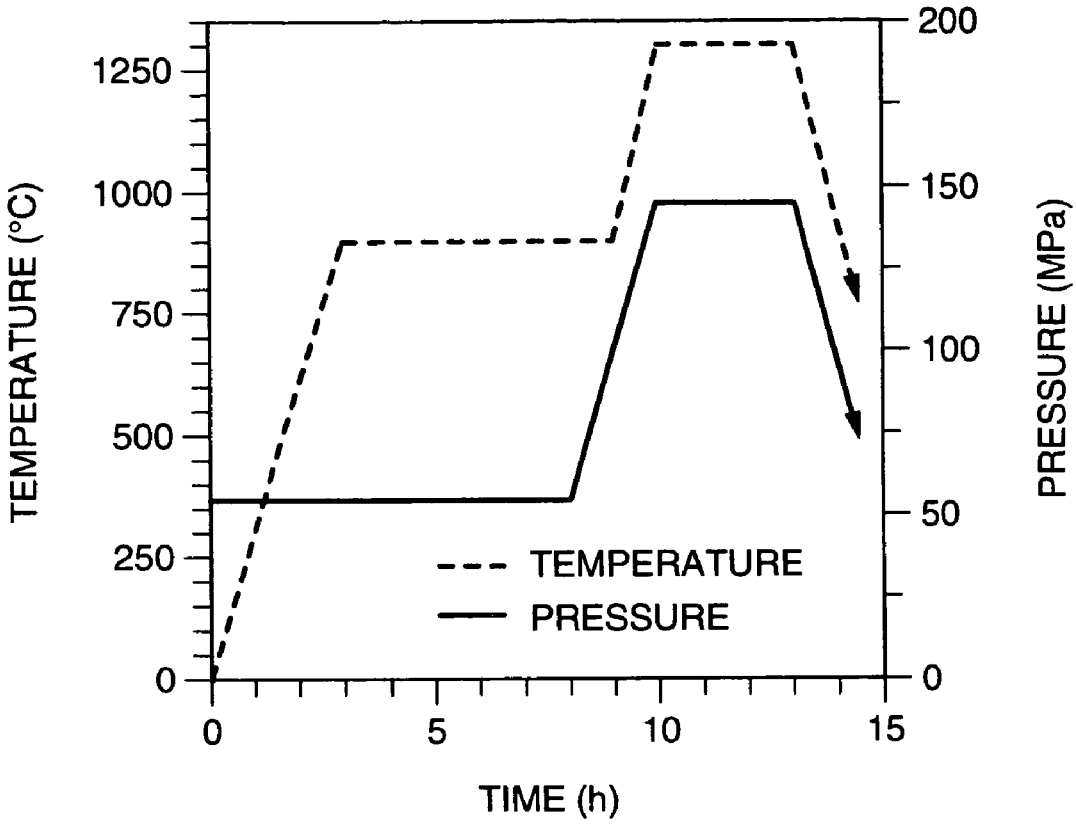
FIG. 9 is a graph showing conditions of temperature and pressure in HIP of a comparative sample in the Example 4.

The HIP condition of the comparative sample shown in FIG. 9 included room temperature as an initial temperature, 54 MPa as an initial pressure, and temperature-rise up to 900° C. in first 3 hours and keeping the temperature for 5 hours. Thereafter, the pressure was increased to 146 MPa over 2 hours, the temperature was raised to 1300° C. over 3 hours since 1 hours out of the above 2 hours had elapsed, and the temperature was kept for 3 hours as it was. Thereafter, the temperature and the pressure were decreased for termination of the HIP.

After the sintering had been terminated, test pieces for oxygen analysis were taken from the sintered bodies of the sample 13 of the invention and the comparative sample 14 at the position A, the position B, and the position C shown in FIG. 4 in the same manner as in the Example 1, and the analysis of oxygen quantity was performed by means of the LECO method. TABLE 5 shows results of the oxygen analysis. Oxygen quantities in TABLE 5 are expressed in mass ppm. It is seen from TABLE 5 that the sintered body of the sample 13 of the invention, in which the getter material was arranged in the metallic container and the processing of expediting deoxidation prior to the main sintering at the time of HIP was incorporated, was adequately reduced in oxygen quantity irrespective of positions in the sintered body.

TABLE 5

| Sample No. | HIP Condition | Oxygen Quantity (ppm) Position A | Position B | Position C | Note |
|---|---|---|---|---|---|
| 13 | FIG. 8 | 150 | 170 | 190 | Example of Invention |
| 14 | FIG. 9 | 140 | 200 | 280 | Comparative Example |

EXAMPLE 5

Figure 10:
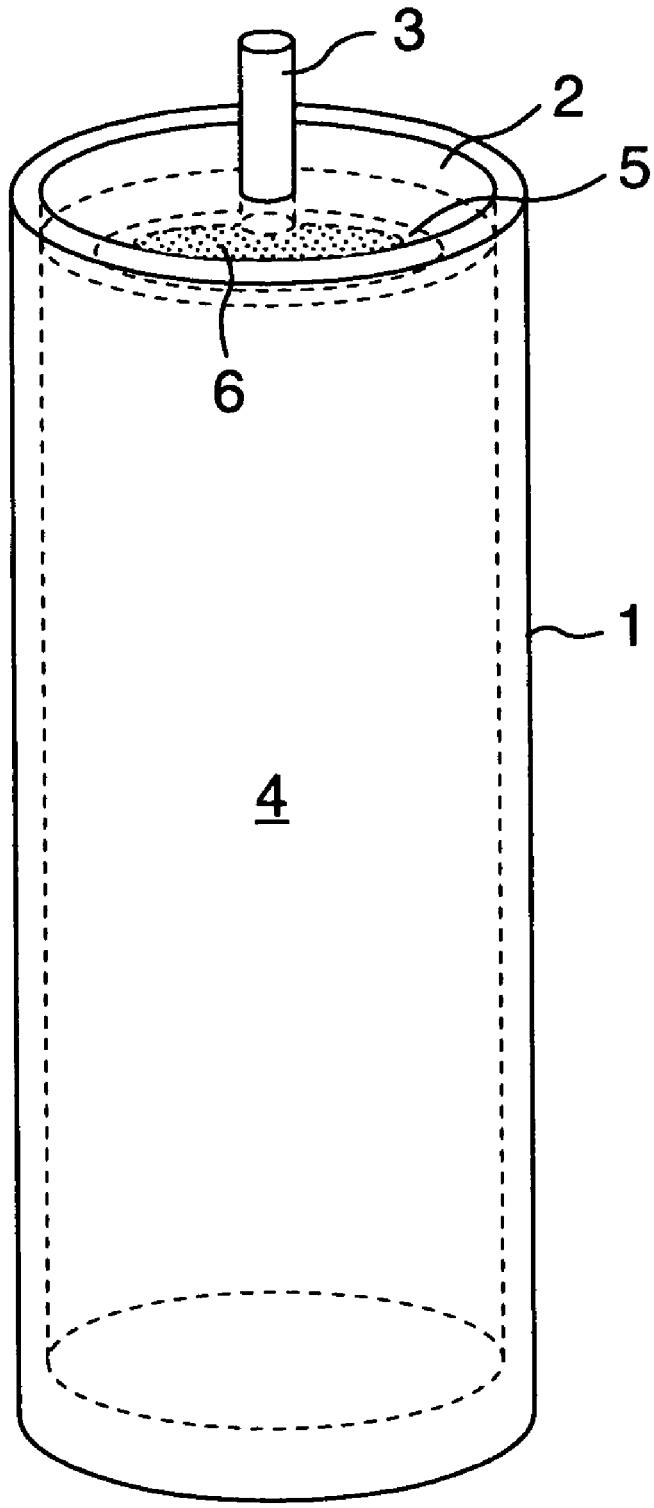
FIG. 10 is a view showing a state of a metallic container, in which a material powder is filled, in an Example 5.

As shown in FIG. 10, after Mo powder containing oxygen of 250 mass ppm, Ru powder containing oxygen of 1000 mass ppm, and powder obtained by mixing Mo powder containing oxygen of 250 mass ppm and W powder containing oxygen of 440 mass ppm so as to give the atomic weight ratio of Mo:W=50:50, respectively, were filled as material powder 4 in a metallic container 1 of low carbon steel with a powder filling space having a diameter of 50 mm and a height of 250 mm, four Ta foil pieces having a diameter of 40 mm and a thickness of 0.12 mm as a getter material 5 and $TiH_2$ powder of 3 g as a hydride 6 were arranged on a back side of an upper lid 2 of the metallic container, the upper lid of the metallic container with a deaerating port 3 was welded to the metallic container, pressure reducing evacuation was performed through the deaerating port 3 up to $1.0\times10^{-2}$ Pa or less while the metallic container was kept at 400° C., and sealing was effected.

Also, Mo powder containing oxygen of 250 mass ppm as material powder 4, both of eight Nb foil pieces having a diameter of 40 mm and a thickness of 0.12 mm, and Zr powder of 17 g, respectively, as a getter material 5, and $TiH_2$ powder of 3 g as a hydride 6 were subjected to pressure reducing evacuation to be sealed in the metallic container 1 in the same manner as described above.

Sintering was performed under the HIP condition shown in FIG. 2 by the use of the metallic container 1 described above.

After the sintering had been terminated, test pieces for oxygen analysis were taken in the same manner as in the Example 1 from the sintered bodies of the sample 15 of the invention with Mo as a material powder, Ta foil pieces as a getter material, and $TiH_2$ powder as a hydride, the sample 16 of the invention with Ru as a material powder, Ta foil pieces as a getter material, and $TiH_2$ powder as a hydride, the sample 17 of the invention with a mixed powder of Mo and W as a material powder, Ta foil pieces as a getter material, and $TiH_2$ powder as a hydride, the sample 18 of the invention with Mo as a material powder, Nb foil pieces as a getter material, and $TiH_2$ powder as a hydride, and the sample 19 of the invention with Mo as a material powder, Zr powder as a getter material, and $TiH_2$ powder as a hydride, at a position A, a position B, and a position C shown in FIG. 3, and the analysis of oxygen quantity was performed by means of the LECO method. TABLE 6 shows results of the oxygen analysis. Oxygen quantities in TABLE 6 are expressed in mass ppm. It is seen from TABLE 6 that the sintered bodies of the samples 15 to 19 of the invention, in which the getter material and the hydride were arranged in the metallic container and the processing of expediting deoxidation prior to the main sintering at the time of HIP was incorporated, were adequately reduced in oxygen quantity irrespective of positions in the sintered bodies.

TABLE 6

| Sample No. | Material Powder | Getter Material | Hydride | Oxygen Quantity (ppm) Position A | Position B | Position C | Note |
|---|---|---|---|---|---|---|---|
| 15 | Mo | Ta Foil Piece | $TiH_2$ | 49 | 50 | 47 | Examples of Invention |
| 16 | Ru | Ta Foil Piece | $TiH_2$ | 22 | 24 | 26 | |
| 17 | Mo—50 at % W | Ta Foil Piece | $TiH_2$ | 55 | 52 | 55 | |

TABLE 6-continued

| Sample No. | Material Powder | Getter Material | Hydride | Oxygen Quantity (ppm) Position A | Position B | Position C | Note |
|---|---|---|---|---|---|---|---|
| 18 | Mo | Nb Foil Piece | $TiH_2$ | 60 | 60 | 58 | |
| 19 | Mo | Zr Powder | $TiH_2$ | 43 | 40 | 45 | |

What is claimed is:

1. A method of manufacturing a sintered body, comprising sealing a material powder composed of metallic powder or alloy powder and a getter material having a higher oxidation potential than that of the material powder under reduced pressure in a metallic container, keeping the metallic container at pressure not higher than 50 MPa and at temperature not lower than 500° C. for 1 to 50 hours, at which conditions sintering of the material powder is not started, and then sintering the material powder in the metallic container at pressure higher than 50 MPa and at temperature not higher than 1340° C.

2. The method according to claim 1, wherein the getter material comprises an element or elements belonging to the IVa group or the Va group of the periodic table of the elements.

3. The method according to claim 1, wherein the metallic powder and the alloy powder have a melting point not lower than 1600° C.

4. A method according to claim 1, wherein a material powder composed of metallic powder or alloy powder having a melting point not lower than 1600° C., and a getter material having a higher oxidation potential than that of the material powder and comprising an element or elements belonging to the IVa group or the Va group of the periodic table of the elements are sealed under reduced pressure in the metallic container.

5. A method of manufacturing a sintered body, comprising sealing a material powder composed of metallic powder or alloy powder, a getter material having a higher oxidation potential than that of the material powder, and a hydride, which constitutes a hydrogen source, under reduced pressure in a metallic container, keeping the metallic container at pressure not higher than 50 MPa and at temperature not lower than 500° C. for 1 to 50 hours at which conditions sintering of the material powder is not started, and then sintering the material powder in the metallic container at pressure higher than 50 MPa and at temperature not higher than 1340° C.

6. The method according to claim 5, wherein the getter material comprises an element or elements belonging to the IVa group or the Va group of the periodic table of the elements.

7. The method according to claim 5, wherein the metallic powder and the alloy powder have a melting point not lower than 1600° C.

8. The method according to claim 5, wherein an element combining with hydrogen to form the hydride has a hydrogen dissociation temperature higher than 400° C.

9. A method according to claim 5, wherein a material powder composed of metallic powder or alloy powder having a melting point not lower than 1600° C., a getter material having a higher oxidation potential than that of the material powder and comprising an element or elements belonging to the IVa group or the Va group of the periodic table of the elements, and the hydride having a hydrogen dissociation temperature higher than 400° C. are sealed under reduced pressure in the metallic container.

* * * * *